US011438709B2

(12) United States Patent
Lara-Quintanilla et al.

(10) Patent No.: US 11,438,709 B2
(45) Date of Patent: Sep. 6, 2022

(54) ACOUSTIC FILTER WITH ENHANCED VALVE STROKE

(71) Applicant: Sonova AG, Staefa (CH)

(72) Inventors: Adrian Lara-Quintanilla, Eindhoven (NL); Pieter Gerard Van 'T Hof, Rotterdam (NL); Engbert Wilmink, Delft (NL)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/287,939

(22) PCT Filed: Nov. 14, 2019

(86) PCT No.: PCT/NL2019/050743
§ 371 (c)(1),
(2) Date: Apr. 22, 2021

(87) PCT Pub. No.: WO2020/101491
PCT Pub. Date: May 22, 2020

(65) Prior Publication Data

US 2021/0409874 A1 Dec. 30, 2021

(30) Foreign Application Priority Data

Nov. 15, 2018 (NL) ..... 2022005

(51) Int. Cl.
*H04R 25/00* (2006.01)
*H04R 9/02* (2006.01)

(52) U.S. Cl.
CPC ..... *H04R 25/456* (2013.01); *H04R 9/025* (2013.01); *H04R 2460/11* (2013.01)

(58) Field of Classification Search
CPC .. H04R 25/456; H04R 9/025; H04R 2460/11; H04R 1/1041; H04R 2225/61
See application file for complete search history.

(56) References Cited

U.S. PATENT DOCUMENTS 6,247,678 B1 6/2001 Hines et al.
6,549,635 B1 4/2003 Gebert
(Continued)

FOREIGN PATENT DOCUMENTS

WO WO 2014/030998 A1 2/2014
WO WO 2017/176803 A1 10/2017
WO WO 2018/070876 A1 4/2018

OTHER PUBLICATIONS

European Patent Office, International Search Report in corresponding International Application No. PCT/NL2019/050743, dated Feb. 3, 2020 (2 pages).

*Primary Examiner* — Sunita Joshi
(74) *Attorney, Agent, or Firm* — Leydig, Voit & Mayer, Ltd.

(57) ABSTRACT

An acoustic filter (100) comprises a filter housing (10) with an acoustic channel (11) and acoustic valve (20) in the channel. The acoustic valve (20) can be moved to along a trajectory (S) between positions (P1, P2). An actuator (30) is configured to actuate the acoustic valve (20) along the trajectory (S). The actuator (30) comprises one or more mechanical elements (31,32). The mechanical elements can move the acoustic valve (20) along at least an initial part of the trajectory. The actuator (30) comprises one or more magnetic elements (41, 42) with a magnetic field (M1,M2) configured to exert a magnetic force (Fm) on the acoustic valve (20). This may help to move the acoustic valve (20) to the second position (P2) along a final part of the trajectory and keep the acoustic valve (20) at the second position (P2). Accordingly the stroke of the valve can be enhanced.

20 Claims, 8 Drawing Sheets

(56) References Cited

U.S. PATENT DOCUMENTS

| | | | | |
|---|---|---|---|---|
| 2014/0169603 | A1* | 6/2014 | Sacha | H04R 25/652<br>381/324 |
| 2020/0196044 | A1* | 6/2020 | Tiefenau | H04R 1/1058 |

* cited by examiner

Ltotal
Lc
Le
P1
30
31w
32w
Ts
Ts
41
20
42

Le
Lc
P2
30
S12
TH
41
20
42
Fm
Fc

Le
Lc
P2
30
Ts
Ts
41
20
42

Lc
Le
P1
30
S21
TH
41
20
42

Lc
Le
P1
30
Ts
Ts
41
20
42
Smax
C

ACOUSTIC FILTER WITH ENHANCED VALVE STROKE

CROSS-REFERENCE TO RELATED APPLICATIONS

This patent application is a U.S. National Phase of PCT International Application No. PCT/NL2019/050743, filed Nov. 14, 2019, which claims priority to Netherlands Application No. 2022005, filed Nov. 15, 2018, which are both expressly incorporated by reference in their entireties, including any references contained therein.

TECHNICAL FIELD AND BACKGROUND

The present disclosure relates to an acoustic filter and method for a filtering sound in hearing devices such as hearables, hearing protection devices, hearing aids, hearing instruments, hearing communication units, or other hearing related wearables.

Nowadays there are many hearing devices, e.g. formed as ear buds or headphones, on the market that are worn in or on the ear and have an acoustical seal to the ear. Wearing a product like that may give the user a feeling that he is occluded and cut from his surroundings. Furthermore prolonged use may lead to irritated ears, as the ears are not ventilated. Hence there is a market for an acoustic or ambient channel in products like hearables, hearing aids and headphones. The acoustic channel is an acoustical path through such a product, which may be acoustically sealed on the sides, having an opening on the beginning (the external or outer ear side) and at the end (the ear drum side or inner ear).

It may be desired that the acoustic channel can provide different modes. In the first mode, e.g. open, it preserves natural hearing, in the second mode, e.g. closed by a valve, it may provide a seal from the environment and/or enhanced sound quality (compared to open mode sound). The product may also include an ambient filter to preserve audio performance and/or to reach a better ambient performance. Furthermore, in the open mode the occlusion effect may be lowered and the ear is ventilated both providing increased wearer comfort. This acoustic channel concept can be combined with (any combination of) communication devices, hearing protection, hearing aids and hearables/earphones.

Hearing devices with an acoustical valve/acoustical filter are described e.g. in WO2014030998, WO2007NL50078, US2016202529. Acoustical valves are in general controlled by small actuators. Unfortunately, these actuators are able to produce only small strokes of the valve, given their small size. So there is yet a desire to improve these and other aspects of known acoustic filters.

SUMMARY

Aspects of the present disclosure relate to an acoustic filter and corresponding method. The acoustic filter typically comprises a filter housing. An acoustic channel can be provided through the filter housing for transmitting sound. An acoustic valve can be arranged in the acoustic channel. The acoustic valve can be moved to along a trajectory, e.g. between a first position and a second position. This may result in varying an acoustic characteristic of sound transmitted through the acoustic channel between the respective valve positions. An actuator can be configured to actuate the acoustic valve along the trajectory. Preferably, the actuator comprises one or more mechanical elements. At least one of the mechanical elements is configured to move the acoustic valve along at least an initial part of the trajectory away from the first position by exerting a contact force on the acoustic valve. Most preferably, the actuator may comprise one or more magnetic elements with a magnetic field configured to exert a magnetic force on the acoustic valve acting in conjunction with the contact force exerted by the mechanical element. This may help to move the acoustic valve to the second position along at least a final part of the trajectory and keeping the acoustic valve at the second position. Accordingly the stroke of the valve can be enhanced.

BRIEF DESCRIPTION OF DRAWINGS

These and other features, aspects, and advantages of the apparatus, systems and methods of the present disclosure will become better understood from the following description, appended claims, and accompanying drawing wherein:

DESCRIPTION OF EMBODIMENTS

Figure 1A:
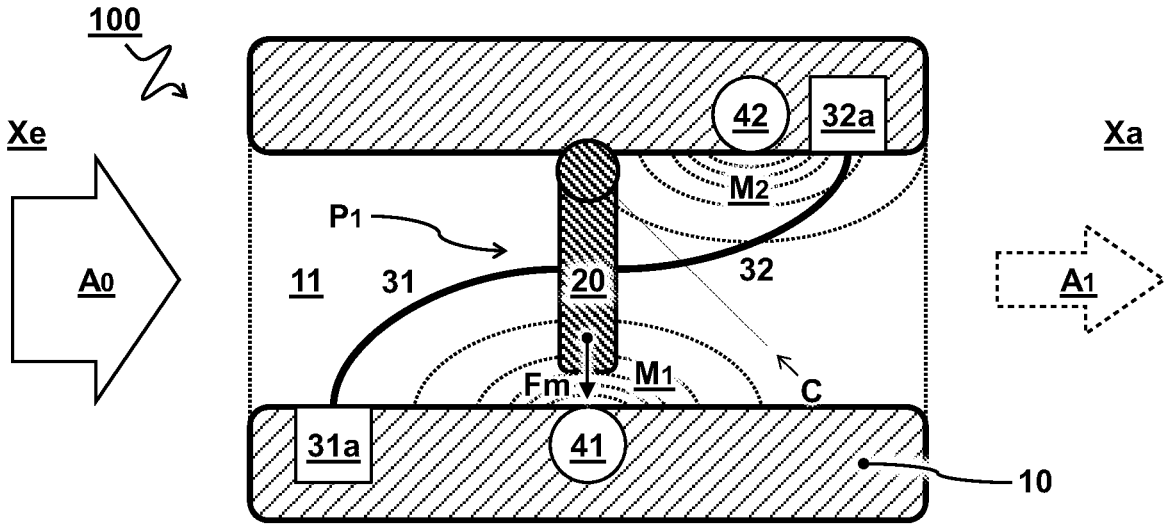
FIGS. 1A-1C illustrate an acoustic filter with an acoustic valve in various positions.

Terminology used for describing particular embodiments is not intended to be limiting of the invention. As used herein, the singular forms "a", "an" and "the" are intended to include the plural forms as well, unless the context clearly indicates otherwise. The term "and/or" includes any and all combinations of one or more of the associated listed items. It will be understood that the terms "comprises" and/or "comprising" specify the presence of stated features but do not preclude the presence or addition of one or more other features. It will be further understood that when a particular step of a method is referred to as subsequent to another step, it can directly follow said other step or one or more intermediate steps may be carried out before carrying out the particular step, unless specified otherwise. Likewise it will be understood that when a connection between structures or components is described, this connection may be established directly or through intermediate structures or components unless specified otherwise.

In-ear electrical and acoustic devices require a great degree of miniaturization. When looking for an automatic acoustic valve which needs to be open and closed, novel actuation means can be taken into account. Smart actuators (those whose actuation is based on smart materials) have very interesting characteristics regarding to miniaturization, simplicity and power efficiency. Much about their characteristics, advantages and drawbacks can be found in scientific literature.

As described herein, shape memory alloys (SMAs) are considered as the most suitable actuator for its purpose, especially in form of wires. SMAs have a huge power density (power which they can exert per volume unit), exerting a combination of force and stroke greater than any other known smart material. Even so, and given that the stroke of an SMA wire is a percentage of its length (typically about 3%), when the actuator is miniaturized, the available stroke to build a moveable valve is limited. Moreover, and as it will be explained below, there also are some issues with SMA wires which need to be addressed. So a need exists for a smart use of such little available stroke by means of a smart design of the device.

As will be described in further detail below, some embodiments may provide methods for increasing the available stroke by means of attraction and repulsion of permanent magnets. In other or further embodiments, the mechanical actuator can be used in to move such magnets. Thus, the stroke available to create an acoustic valve can be significantly bigger than that of the actuator.

In some embodiments, a bi-stable actuator is desired, that is, an actuator that can move between two positions and remain at any of those without consuming power. This can be achieved by creating an actuator based on antagonist SMA wires, which may involve the use of, at least, two SMA wires, which act against each other. When one contracts, the other one elongates and is ready to be contracted, all happening at the same time that the mechanism (the acoustic valve, in this case) is moved as well. Then, the elongated wire is ready to contract as soon as enough electricity is passed through it, thus moving the actuator to its side and elongating the other wire. This mechanism is bi-stable and can be used cyclically as will be described in the following.

The invention is described more fully hereinafter with reference to the accompanying drawings, in which embodiments of the invention are shown. In the drawings, the absolute and relative sizes of systems, components, layers, and regions may be exaggerated for clarity. Embodiments may be described with reference to schematic and/or cross-section illustrations of possibly idealized embodiments and intermediate structures of the invention. In the description and drawings, like numbers refer to like elements throughout. Relative terms as well as derivatives thereof should be construed to refer to the orientation as then described or as shown in the drawing under discussion. These relative terms are for convenience of description and do not require that the system be constructed or operated in a particular orientation unless stated otherwise.

Figure 1B:
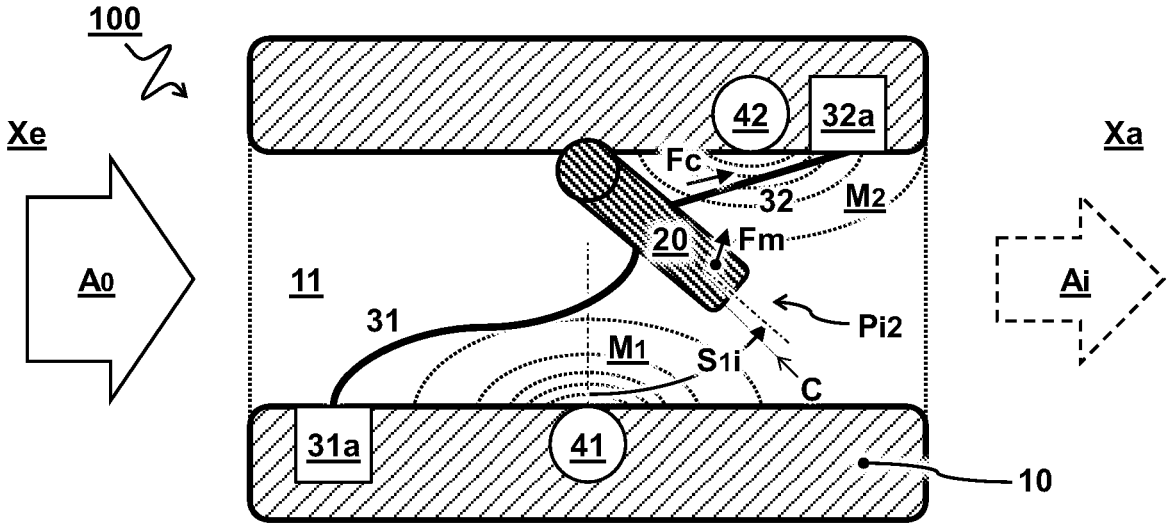
Figure 1C:
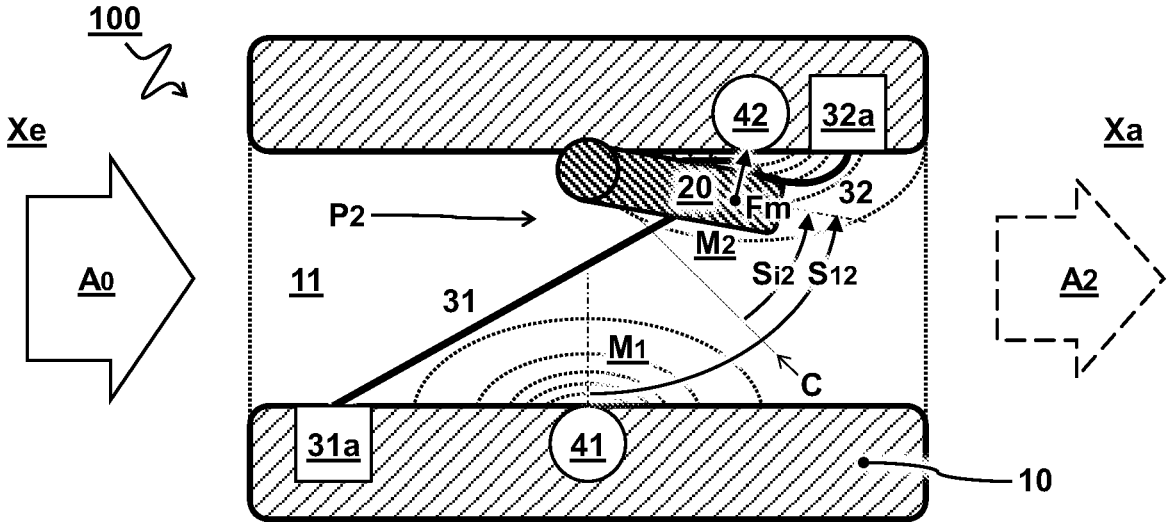

FIGS. 1A-1C schematically illustrate an acoustic filter 100 with an acoustic valve 20 in various positions P1,Pi2,P2, respectively. Specifically, FIG. 1A illustrates the valve in a first position "P1" which in this case is closed; FIG. 1B illustrates the valve in an intermediate position "Pi2" which is between first and second positions P1,P2; and FIG. 1C illustrates the valve in the second position "P2" which in this case is open.

In one embodiment, as shown, the acoustic filter 100 comprises a filter housing 10. Typically, the acoustic filter 100 comprises an acoustic channel 11 through the filter housing 10. In the embodiment shown, an acoustic valve 20 is arranged in the acoustic channel 11. Preferably, the acoustic valve 20 is configured to allow it to be moved along a trajectory "S12" between a first position "P1" and a second position "P2". This may cause varying an acoustic characteristic A1,A2 of sound transmitted through the acoustic channel 11 between the respective valve positions P1,P2. For example, an actuator 30 is configured to actuate the acoustic valve 20 along the trajectory "S12".

In some preferred embodiments, the actuator 30 comprises one or more mechanical elements 31,32. Most preferably at least one of the mechanical elements is configured to move the acoustic valve 20 along at least an initial part of the trajectory S1*i* away from the first position "P1". For example, the mechanical element 32 may exert a physical (contact) force "Fc" on the acoustic valve 20, e.g. by pulling the valve in this case.

In other or further preferred embodiments, the actuator 30 comprises one or more magnetic elements 41,42. The magnetic elements 41,42 may generate a magnetic field M1,M2 configured to exert a magnetic force "Fm" on the acoustic valve 20. The magnetic force "Fm" may act in conjunction with the contact force "Fc" exerted by the mechanical element 32. This may help to move the acoustic valve 20 to the second position "P2" along at least a final part of the trajectory Si2. Additionally, or alternatively, the magnetic force may help to keep the acoustic valve 20 at the second position "P2".

In one embodiment, the mechanical element 32 has only a limited stroke to move the acoustic valve 20 along the initial part of the trajectory S1*i*. For example, the limited stroke may take the acoustic valve 20 from the first position "P1" to an intermediate position "Pi2" which is partway between the first position "P1" and the second position "P2". In another or further embodiment, the magnetic field M1,M2 is configured to move the acoustic valve 20 by the magnetic force "Fm" on the acoustic valve 20 along the final part of the trajectory Si2. So the magnetic force "Fm" may take the acoustic valve 20 from the intermediate position "Pi2" to the second position "P2". Accordingly, the magnetic field may provide an enhanced stroke to move the acoustic valve 20 beyond the limited stroke of the mechanical element 32.

In some preferred embodiments, the valve 20 can be controlled to remain in one of multiple controlled states P1,P2 after being actuated. Preferably, the actuator, e.g. mechanical elements 31,32 need not remain actively powered or actuated after reaching a controlled state so energy can be saved. For example, the controlled states can be relatively stable. For example, a stable state is retained for a minimum amount of time after the active actuation of the mechanical elements, e.g. providing electricity and/or heating, is stopped. In some embodiments, a stable state is retained after actuation for at least one second, at least ten seconds, al least one minute, or more time, e.g. indefinitely. The longer the state can be maintained without active powering, the more stable the control over that state.

In some embodiments, the actuator may be configured to control the system between two stable states. This is also referred to as a bi-stable system. In other or further embodiments, the actuator may allow more than two stable states (not shown). For example, one or more additional magnetic element can be disposed at one or more intermediate positions (not shown) to provide one or more intermediate stable states.

As described herein the acoustic channel 11 is configured to form at least part of an acoustic pathway P between an auditory canal Xa and external surroundings Xe. In some embodiments, e.g. as shown, the actuator is configured to control a valve at least between relatively open and relatively closed states. The state of the valve may determine the acoustic characteristic A1,A2 of sound transmitted through the acoustic channel 11. The acoustic characteristic may include a degree of attenuation at one or more frequencies or other effect on the transmitted sound, e.g. compared to externally provided sound A0, or internally generated sound (not shown here) in the acoustic filter or hearing device. For example, the acoustic filter 100 may provide more attenuation when the acoustic valve 20 is closed (here the first position "P1") than when the valve is open (here the second position "P2").

The valve may provide a barrier to substantially block transmitted sound in the closed state, e.g. providing attenuation between sound A0 entering the acoustic channel 11 and sound A1 exiting into the ear canal, wherein the attenuation or noise reduction rating in the closed state (at least in an audible frequency range) is more than ten decibel, preferably more than twenty decibel, most preferably more than thirty decibel, or more. Alternatively, or in addition to a valve blocking sound, the valve may also include acoustic elements such as a mesh or membrane (not shown) which may affect the transmitted sound in other ways, e.g. controllably shape the acoustic characteristic depending on the state of the valve. For example, one or more meshes may be controllably inserted or removed from the sound passage (not shown).

In some embodiments, the acoustic valve 20 comprises a magnet or magnetisable material for allowing the magnetic field M1,M2 to directly exert the magnetic force "Fm" on the acoustic valve 20. For example, the acoustic valve 20 may comprise a flap or door which is made of, or otherwise includes, magnetic material. Alternatively or in addition, magnetisable material may be indirectly attached to the acoustic valve (not shown), such that magnetic force on the material causes the movement and/or holding of the valve.

Starting e.g. from the situation depicted in FIG. 1A, when the valve 20, e.g. comprising magnetisable material or a third magnet (not shown) or, is moved along a trajectory "S12" between two stationary magnets 41,42, the magnetic field M1,M2 (of magnet 41) may first cause a magnetic force "Fm" which tries to pull back the moving object. Then, as shown in FIG. 1B, once a threshold "C" between the stationary magnets 41,42 is crossed, the magnetic force "Fm" may act in conjunction with the contact force "Fe" exerted by the mechanical element 32 for helping to move the acoustic valve 20 to the second position "P2" along the final part of the trajectory Si2. Once the acoustic valve 20 arrives at the second position "P2", the magnetic force may also help to keep it at the second position "P2", as shown in FIG. 1C. It may be noted that the final part of the trajectory may be affected predominantly by the magnetic force, e.g. due to the limited stroke of the mechanical element 32 (here shown as a wire).

In some embodiments, the magnetic field M1,M2 is configured to only effectively exert the magnetic force "Fm" for moving the acoustic valve 20 to the second position "P2" after the acoustic valve 20 is moved by the at least one of the mechanical elements 32 beyond a threshold position "C" away from the first position "P1". For example, the intermediate position "Pi2" is between the threshold position "C" and the second position "P2". While the magnetic field of a magnet may theoretically extend over long distances, the magnetic force "Fm" may be considered effective if it can actually contribute to movement (of the valve) in the desired direction. Typically, the magnetic field M1,M2 of a respective magnet 41,42 is stronger at positions closer to the respective magnet. Furthermore, the magnetic field M2 of one of the magnetic elements 42 may be (partially) counteracted in intermediate positions by the magnetic field M1 other another magnetic element 41. For example, the two stationary magnets 41,42, as shown may create a magnetic field M1,M2 between them that is relatively strong at positions close to the respective magnets and relatively weak there between. So the magnetic force "Fm" to move the valve to the second position may be effective e.g. beyond the threshold C relatively closer to the magnetic elements 42.

As described herein, the one or more mechanical elements 31,32 may be directly or indirectly connected to make or maintain contact with the acoustic valve 20 for exerting the contact force "Fc". As will be understood, a contact force "Fc" exerted by an actor on an object is a force mediated by direct or indirect contact between the actor and the object. Typically, this may include physically pushing or pulling the object. As described herein, a contact force may be exerted by a mechanical element pushing or pulling on an acoustic valve. For example, as shown. a contact force "Fe" on the acoustic valve 20 may be exerted by pulling a wire attached to the valve. Alternatively, or in addition, the valve may be pushed or pulled by other mechanical elements, e.g. constructed of piezoelectric material, piezoelectric stacks, benders, electro-magnetic actuators and shape memory alloys, such as shape memory alloy wires.

Contact forces may be distinguished from "action-at-a-distance forces", most notably, the magnetic force "Fm" which can act on an object without relying on mediation of the force by physical contact between the actor, e.g. magnet, and the object, e.g. valve. As described herein, one or more magnetic elements 41,42 may be configured to generate a magnetic field M1,M2 for magnetically attracting or repelling the acoustic valve 20. Of course it is not excluded that parts such as the magnet and valve can be indirectly connected, e.g. via the filter housing and wiring, but the magnetic force does not rely on that contact for mediation of its effect, i.e. moving the valve 20 so there is a conceptual difference.

In one embodiment, as shown, the mechanical elements 31,32 include wires to exert the contact force "Fc" by pulling the acoustic valve 20 away from a respective position "P1",P2. For example, the wires can be pulled by a mechanical control element 31*a*,31*b* such as a (micro)motor. Alternatively, or in addition it is preferred, that the wires themselves are actuated, e.g. contracted as will be described in the following. For example, the mechanical control element 31*a*,31*b* may in such case include means to actuate the wires, e.g. a heating, cooling and/or electrical device to cause contraction (or expansion) of the wires or other shaped material.

FIGS. 2A-2E illustrate examples of various positions provided by mechanical elements in an actuator 30.

In a preferred embodiment, the actuator 30 comprises at least one SMA wire 31*w* as a mechanical element 31 for actuating the acoustic valve 20. The SMA wire comprises a shape-memory alloy (SMA). In some embodiments, the actuator 30 comprises a temperature controller 31*a* such as a heating and/or cooling element for controlling a temperature of the SMA wire 31*w*. For example, the SMA wire 31*w* is configured to contract or extend depending on its temperature to exert a contact force "Fc" by its connection to the acoustic valve 20.

A shape-memory alloy (SMA) also referred to as smart metal, memory metal, memory alloy, muscle wire, smart alloy is an alloy that "remembers" its original shape and that when deformed may return to its pre-deformed shape when appropriate stimulus such as heat is applied. SMA material may provide a lightweight, solid-state actuator as an alternative to conventional actuators such as piezo, hydraulic, pneumatic, and motor-based systems.

SMA actuators are typically actuated electrically, where an electric current results in Joule heating. Deactivation typically occurs by free convective heat transfer to the ambient environment. Consequently, SMA actuation is typically asymmetric, with a relatively fast actuation time and a slow de-actuation time. Optionally, SMA deactivation time can be reduced by features such as forced convection and lagging the SMA with a conductive material in order to manipulate the heat transfer rate. For example, conductive "lagging" may include use of a thermal paste to rapidly transfer heat from the SMA by conduction. This heat is then more readily transferred to the environment by convection as the outer radii and heat transfer area is significantly greater than for the bare wire. This may result in a reduction in deactivation time and a more symmetric activation profile. In some cases, SMA material may exhibit hysteresis, i.e. a dependence of the state of the system on its history. Conventionally, this may hinder some applications of the material in an actuator. However, the inventors find that the hysteresis property can actually be useful for some applications as described herein, e.g. contributing to bistable behavior.

In some embodiments, the mechanical elements 31,32, e.g. SMA wires are affected by temperature. For example, a relatively high temperature "TH" may cause a mechanical element or wire to contract. When the element cools down it may reach a relatively low stabilization temperature TS, e.g. at ambient temperature. In some cases, this may cause partial or complete extension of the wire length. Accordingly, a length of the mechanical elements 31,32 may be related to their temperature.

In a preferred embodiment, the actuator 10 comprises at least two SMA wires 31*w*,32*w* with respective temperature controllers configured to the selectively heat either one of the SMA wires 31*w*,32*w*. This may cause contraction in the heated wire. Furthermore, the contraction (Lch/Les) may result in the contact force "Fc" by pulling the acoustic valve 20 in one of at least two different directions towards the first position "P1" or second position "P2" depending on which wire is heated.

With continued reference to FIGS. 2A-2E, two SMA wires 31*w*,32*w* may provide a valve connection point 20*c* there between to pull the valve (not shown) in either direction depending on which wire is contracted.

Figures 2A, 2B, 2C, 2D, 2E:
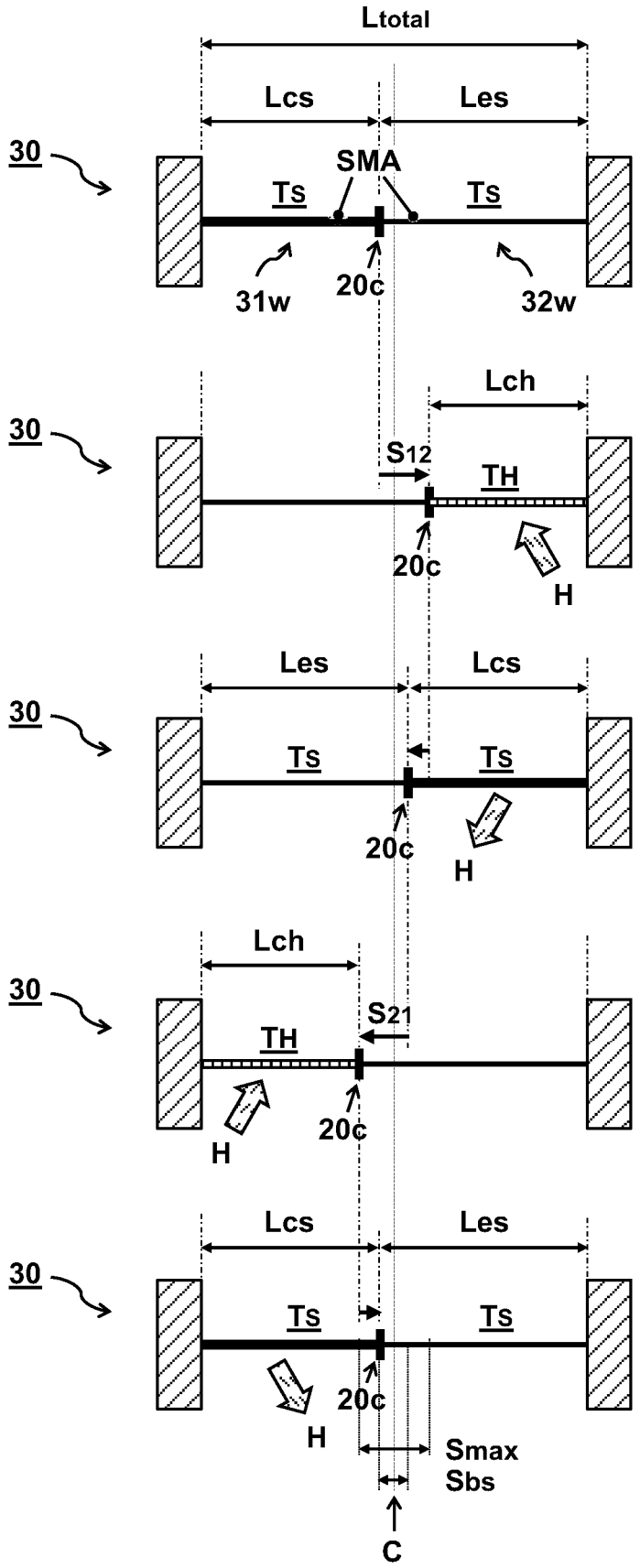
FIGS. 2A-2E illustrate examples of various positions provided by mechanical elements in an actuator.

With specific reference now to FIG. 2A, the wires may start at the same stabilization temperature TS. Alternatively, the temperature may also be different initially (not shown here). In the stabilized situation, one of the wires 31*w* may have a stabilized contracted length "Lcs" and the other wire 32*w* a stabilized extended length "Les". For example, due to hysteresis or prior history, the lengths "Lcs" can be less than the length "Les". Accordingly, the valve connection point 20*c* may be shifted to one position.

With specific reference now to FIG. 2B, the SMA wire 31*w* may provided with heat "H" according to some embodiments. The heat "H" can e.g. be supplied by an electrical current or other heating element (not shown here). This may cause the wire 32*w* to attain a heating temperature "TH". The heating temperature "TH" may cause the wire to contract to a heated contraction length "Lch", e.g. regain its original ("remembered") shape after having previously been extended. Accordingly, mechanical movement can be provided to the valve connection point 20*c* along the trajectory "S12" to another position. A corresponding contact force may be exerted by the valve connection point 20*c* on the valve (not shown here).

In a preferred embodiment, the heated contraction length "Lch" of SMA wires 31*w*,32*w* used in the actuator 30 is shorter than their stabilized extended length "Les" by at least one percent, at least two percent, or at least three percent, or more. The more the relative contraction, the less limited the mechanical stroke which can be provided. The absolute contraction may also be improved by lengthening the SMA wires. In some embodiments, the combination of the SMA wire length and relative contraction provides a mechanical stroke of at least hundred micrometer, preferably at least half a millimeter or even more than one millimeter. Advantageously, limitations in the mechanical stroke can be enhanced by magnetic forces, as described herein.

With specific reference now to FIG. 2C, the previously heated wire 32*w* may lose at least part of the heat "H" so it may cool down to a stabilization temperature TS, which may the same or different from the initial temperature. In any case, the cooling down may cause some re-extension of the wire so the valve connection point 20*c* may move partially back to the center position. Basically, the situation of FIG. 2A is now reversed. It is noted that, in the embodiment shown, the wires 31*w*,32*w* are the same, which is preferred but not necessarily the case for other embodiments. For example, in some embodiments the wires may have different (default) lengths (not shown). Accordingly, if desired, a relatively long first wire can be used to provide a relatively long mechanical stroke for the same relative contraction compared to a relatively short second wire.

With specific reference now to FIG. 2D, the first wire 31*w* is heated to the temperature "TH" which causes that wire to contract and move the valve connection point 20*c* in the other direction along trajectory S21. This is basically the reverse of FIG. 2B.

With specific reference to FIG. 2E, heat "H" may again be removed, e.g. by radiation, convection, or conduction, from the first wire which may cause partial relaxation of the contraction, similar as described with reference to FIG. 2C. Accordingly, the situation of FIG. 2A is recovered. Overall, it may be observed that the bi-stable stroke "Sbs" provided by the actuator of FIGS. 2A-2E can be rather limited, even compared to the maximum stroke "Smax" which can be provided by the relative contraction lengths of the wires. As shown, this may be caused e.g. by the partial re-extension of the wire lengths upon cooling. Accordingly, it is desired to improve the situation in preferred embodiments.

FIGS. 3A-3E illustrate possible improvements provided by adding magnetic elements 41,42 in the actuator 30. In one embodiment, as shown, the magnetic elements 41,42 are arranged to keep the acoustic valve 20 in at least one of the first position "P1" or the second position "P2" after actuation of the mechanical elements 31,32.

Figures 3A, 3B, 3C, 3D, 3E:
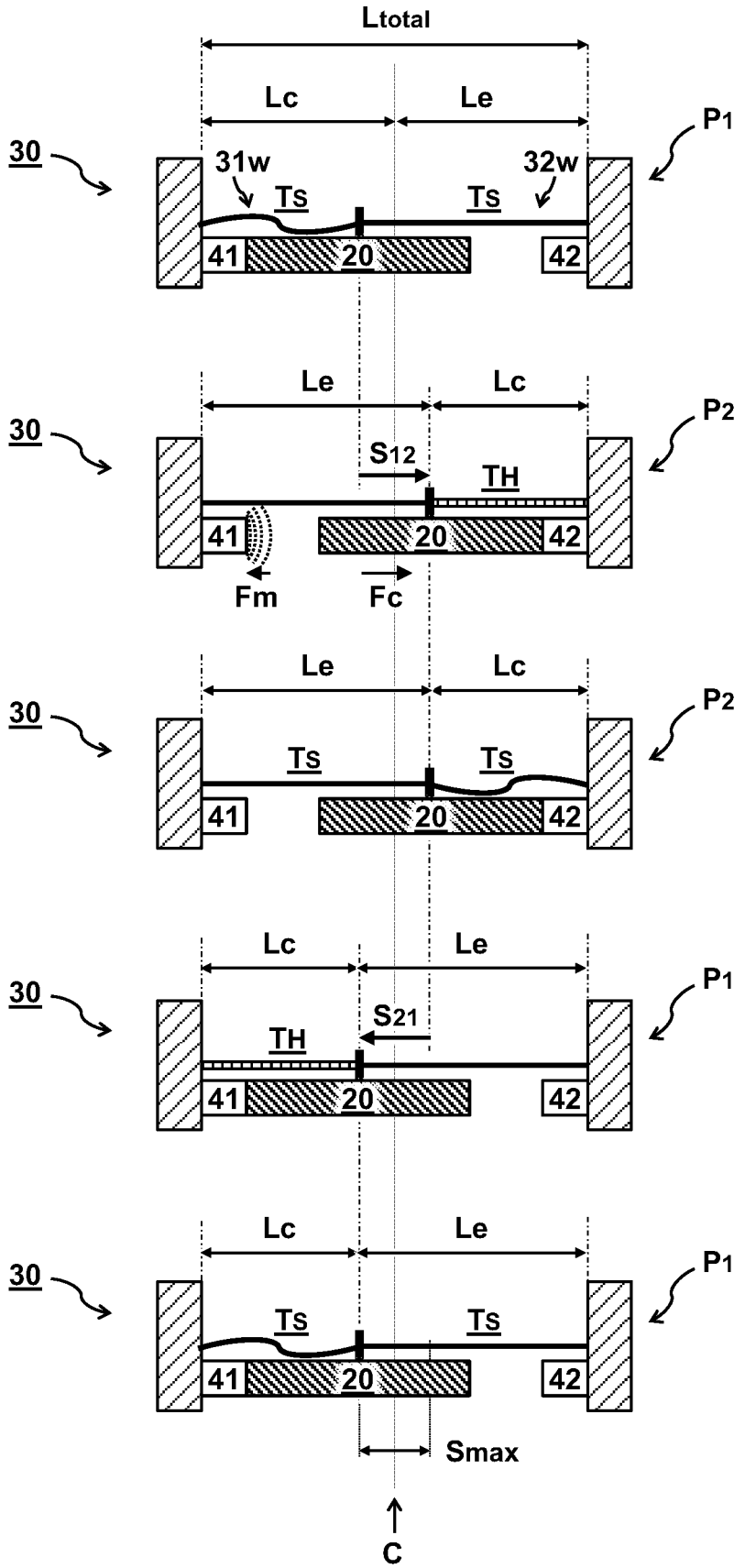
FIGS. 3A-3E illustrate possible improvements provided by adding magnetic elements in the actuator.

It may be noted that FIGS. 3A-3E show similar steps as FIGS. 2A-2E, respectively, except magnets are provided at either ends of the actuator 30 for attracting a valve 20 attached to the wires 31*w*,32*w*. FIG. 3A shows the initial situation where the acoustic valve 20 is attracted to the first magnetic elements 41. As shown, the attraction may hold the valve 20 in place despite possible slack on the wire 31*w*. FIG. 3B shows the second wire 32*w* being heated to contract and pull the valve 20 with its contact force "Fc" away from the first magnetic elements 41 initially against the magnetic force "Fm" of the first magnetic elements 41. Magnetic force of the second magnetic element 42 may also help to pull the valve 20 at least over a final part of the trajectory "S12". As shown in FIG. 3C, the magnetic elements 41,42 may also help to keep the valve 20 in place after the second wire 32*w* cools down and develops slack. FIGS. 3D and 3D show the first wire 31*w* being heated and subsequent cooldown to return to the situation of FIG. 3A. It will be appreciated that the stable maximum stroke "Sbs" of valve is thus improved compared to FIGS. 2A-2E.

While these and other figures show magnetic elements 41,42 attracting a valve 20 with magnetisable material, of course also other configurations with similar functionality can be envisaged. For example, the acoustic valve 20 may comprises a magnetic element, e.g. permanent magnet, in addition or alternative to the magnetic elements 41,42. For example, the elements 41,42 can be substituted for magnetisable elements such as iron blocks where the acoustic valve 20 comprises a permanent magnet attracted to either element. However, an advantage of the embodiment shown with static magnets and moveable magnetisable valve may be that the valve is not inadvertently attracted to other, e.g. metal, elements which may also be comprised in the hearing device (not shown).

FIGS. 4A-4E illustrate possible further improvements provided by magnetic elements 41,42 also helping to enhance the limited stroke S1*i*,S2*i* of mechanical elements such as SMA wires 31*w*,32*w*.

Figures 4A, 4B, 4C, 4D, 4E:
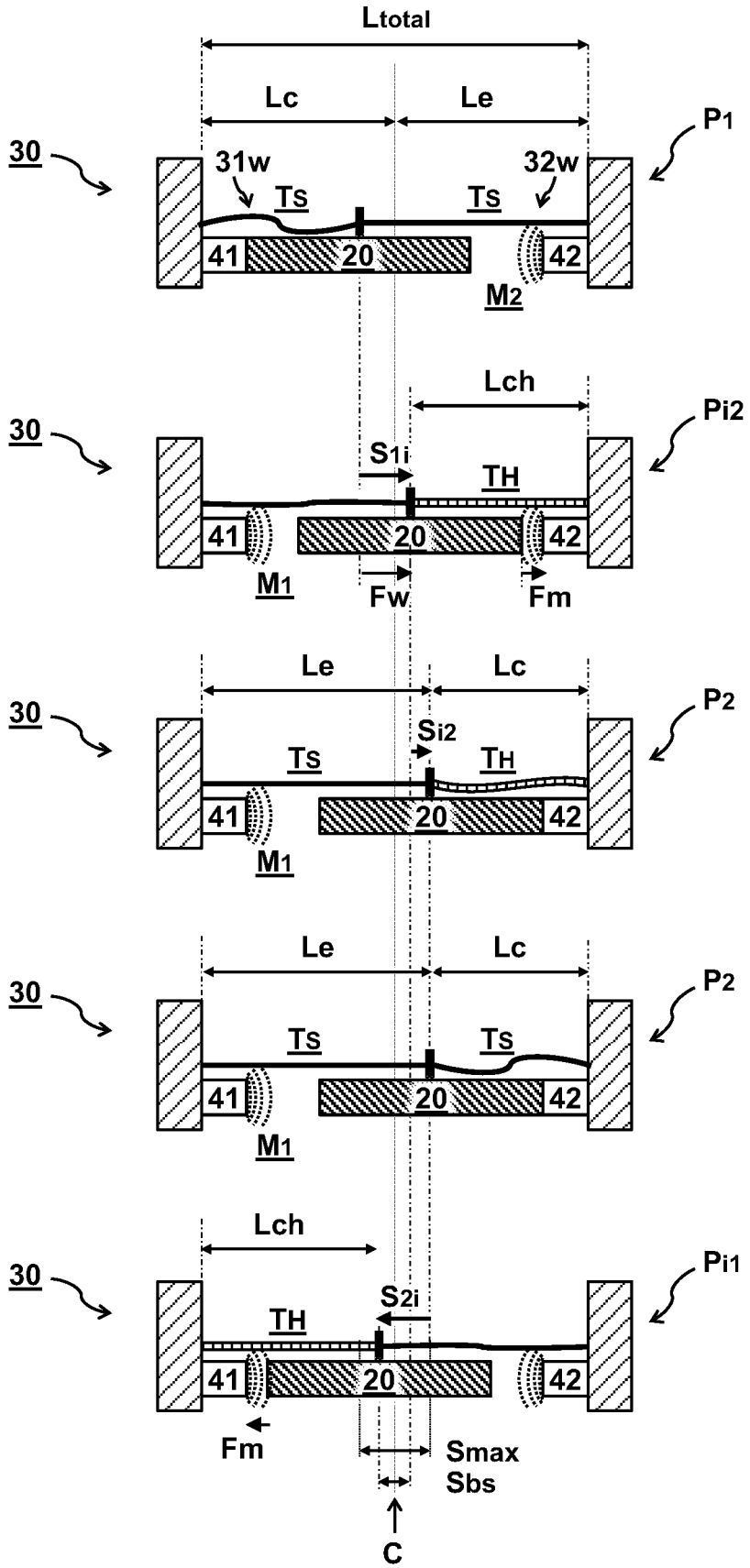
FIGS. 4A-4E illustrate possible further improvements provided by magnetic elements helping to enhance the limited stroke of mechanical elements such as SMA wires.

As illustrated in FIGS. 4A-4C, the actuator 30 may comprise an SMA wire 32*w* configured to be heated to a temperature "TH". This may cause contraction from an initial extended length Le to a heated contraction length "Lch". In turn, the contraction may result in moving the acoustic valve 20 from the first position "P1" to an intermediate position "Pi2". The intermediate position is preferably beyond a threshold position "C". At the same time the intermediate position may be short of the second position "P2" due to limited stroke "Sbs" of the SMA wire, as shown in this embodiment. Advantageously, the magnetic force "Fm" can be configured to move the acoustic valve 20 further beyond the threshold position "C" from the intermediate position "Pi2" to the second position "P2" despite a slack on the SMA wire 32*w* (illustrated by wiggly line).

As shown in FIG. 4D, the slack on the wire 32*w* may further develop as it cools down, but the magnetic element 42 may still keep the acoustic valve 20 locked in the second position "P2" according to some preferred embodiments. Next, FIG. 4E shows the reverse of FIG. 4B wherein the other wire 31*w* is heated to cause the valve 20 to move partially back to another intermediate position S2*i* on the other side of the threshold position "C" closer to the first position "P1". Subsequently, the valve may be attracted to the magnetic element 41 and be locked in the first position "P1" (not shown).

The absolute stroke enhancement provided by the magnet 42 may be expressed e.g. as the difference in relative length (Lch−Lc) between the heated contraction length "Lch" and the shorter length Lc which the wire would have to be to complete the stroke to the second position "P2" on its own (without the magnet). For example, heating causes the wire 32*w* to contract to a length "Lch"=10 mm while the magnet brings it further to Lc=8 mm which would be an absolute stroke improvement of 2 mm. Preferably, the absolute stroke enhancement (Lch Lc) provided by the magnetic elements is at least one millimeter, at least two millimeter or more, e.g. between three and ten millimeter.

The enhancement may also be expressed relatively e.g. as (Lch−Lc)/(Le−Lch), wherein Lch−Lc is again the further distance provided by the magnet to bring it in the second position "P2" and Le is the initial length of the wire 32*w* (when the valve 20 is in the opposite first position "P1"). For example, heating causes the wire 32*w* is initially 12 mm and contracts by heating to a length "Lch"=10 mm while the magnet brings it further to Lc=8 mm which would be a relative stroke improvement of (10−8)/(12−10)=100% i.e. twice as good. Preferably, the relative stroke enhancement (Lch−Lc)/(Le−Lch) provided by the magnetic elements is at least ten percent, twenty percent, fifty percent or more, e.g. hundred percent.

Figure 5A:
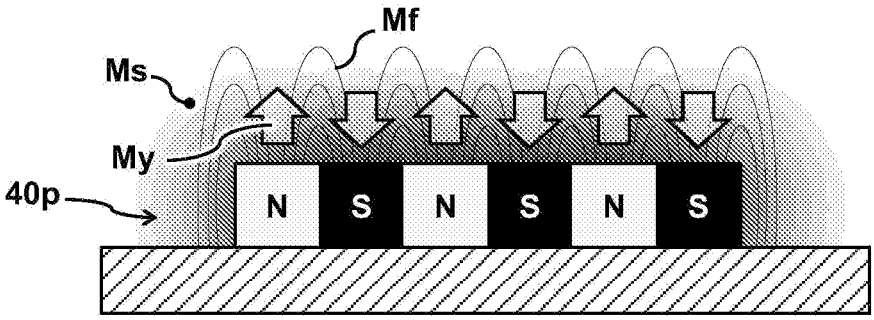
FIGS. 5A-5D schematically illustrate various properties of permanent magnets and possible applications as used herein.
Figure 5B:
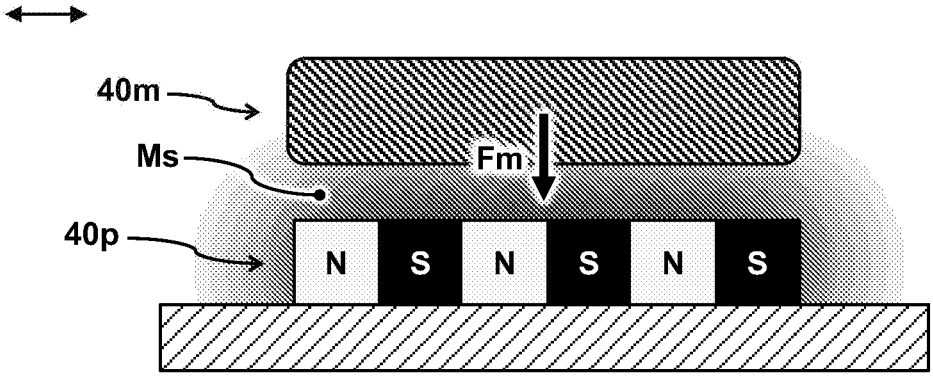
Figure 5C:
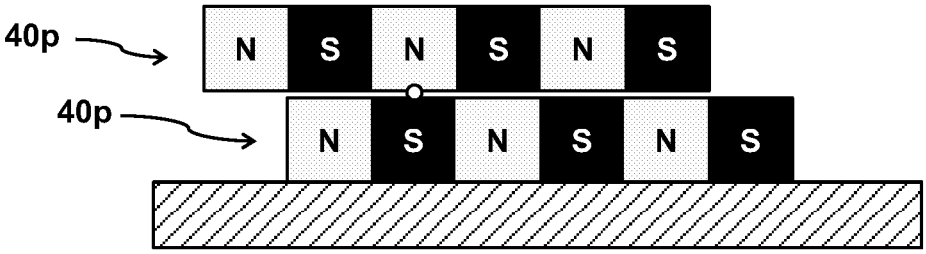
Figure 5D:
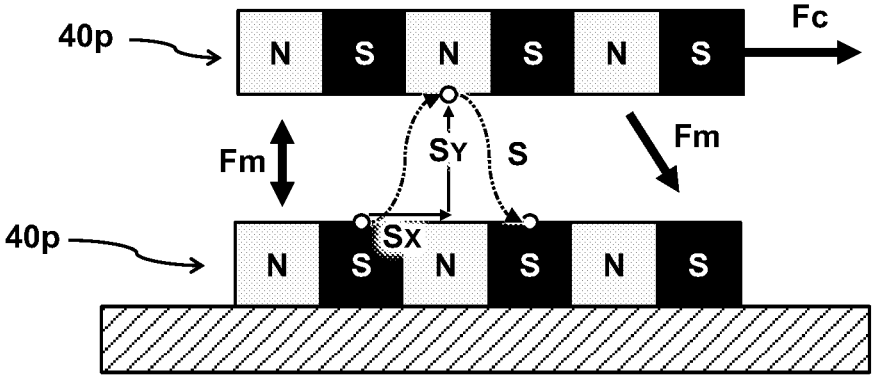

FIGS. 5A-5D schematically illustrate various properties of permanent magnets 40*p* and magnetisable material 40*m*, and possible applications as used herein. FIG. 5A illustrates a permanent magnet 40*p* with alternating poles "N", "S"; FIG. 5B illustrates the permanent magnet 40*p* attracting a magnetisable object 40*m*; FIG. 5C illustrates two permanent magnets 40*p* with their opposite poles "N", "S" attracted to each other; and FIG. 5D illustrates a moveable top magnet being pulled or pushed sideways by a contact force "Fc" and resulting trajectory "S" due to the magnetic repulsion and attraction of respective poles from the stationary bottom magnet.

As generally understood, a permanent magnet is an object made from a material that is magnetized and creates its own persistent magnetic field. This may be contrasted to an electromagnet which only generates a magnetic field when a current is applied. In principle either type of magnet can be used for applications as described herein, but it may be preferable in some embodiments to use a permanent magnet e.g. because it does not require electricity to sustain the magnetic field.

Generally, a magnet may attract other magnets of the opposite polarity, so the north pole "N" of one magnet may attract the south pole "S" of another magnet, and vice versa. Conversely, magnetic poles of the same polarity may also repel each other, so the north pole "N" of one magnet may repel the north pole "N" of another magnet, and similar for two south poles "S". Magnets may also attract other (non-permanent) magnetic or magnetisable materials. Most notably, ferromagnetic materials such as iron, nickel, cobalt, and most of their alloys, may show a relatively strong attraction to a nearby magnet. Such material may be attracted irrespective of the polarity, wherein the magnetic force "Fm" is e.g. in a direction where the magnetic field is highest.

For illustration, magnetic field lines "Mf" can be drawn from a magnetic north pole "N" to a magnetic south pole "S". The direction of the field lines may be associated with a direction of the magnetic field, here indicated by block arrows "My". The density of the field lines (closeness of the lines) may be associated with the magnetic field strength, here indicated by grayscale "Ms", where darker regions represent higher field strength. While the figures show alternating magnets including only north and south poles, also poles with other, e.g. intermediate, directions may be included in some embodiments, such as a Halbach array of discrete or continuously rotating magnetization directions. For example, a Halback array may provide advantage of a relatively strong magnetic field at one side of the array (the side of the valve) compared to the other.

In some embodiments, as illustrated by FIG. 5B, it can be advantageous to make the acoustic valve of a magnetisable material 40*m*, so it will be attracted to magnets irrespective of polarity. In other or further embodiments, as illustrated by FIGS. 5C and 5D, it can be advantageous to include one or more magnetic poles 40*p* in the acoustic valve, so the valve may show selective attraction or repulsion depending on relative polarity to other magnetic elements. For example, the magnetic poles of the magnets in FIG. 5C are aligned to have magnetic north poles "N" on the (movable) top magnet facing magnetic south poles "S" on the (stationary) bottom magnet, and vice versa. When the top magnet is moved, e.g. by a physical force i.e. contact mediated force "Fc" to the right, the poles may misalign causing repulsion of like poles. As a result, the top magnet may be first pushed away by (contactless) magnetic force "Fm" in an upward direction transverse to the sideways contact force "Fc". Then as the magnets of opposite polarity realign, the magnets may again be attracted to each other. It will be appreciated that e.g. in the initial part of the trajectory S, the upward displacement Sy caused by repulsion of the magnet force "Fm" can be greater than the transverse sideway displacement Sx caused by the contact force "Fc". These and other effects can be exploited to further enhance the stroke in some embodiments as discussed in the following.

Figure 6A:
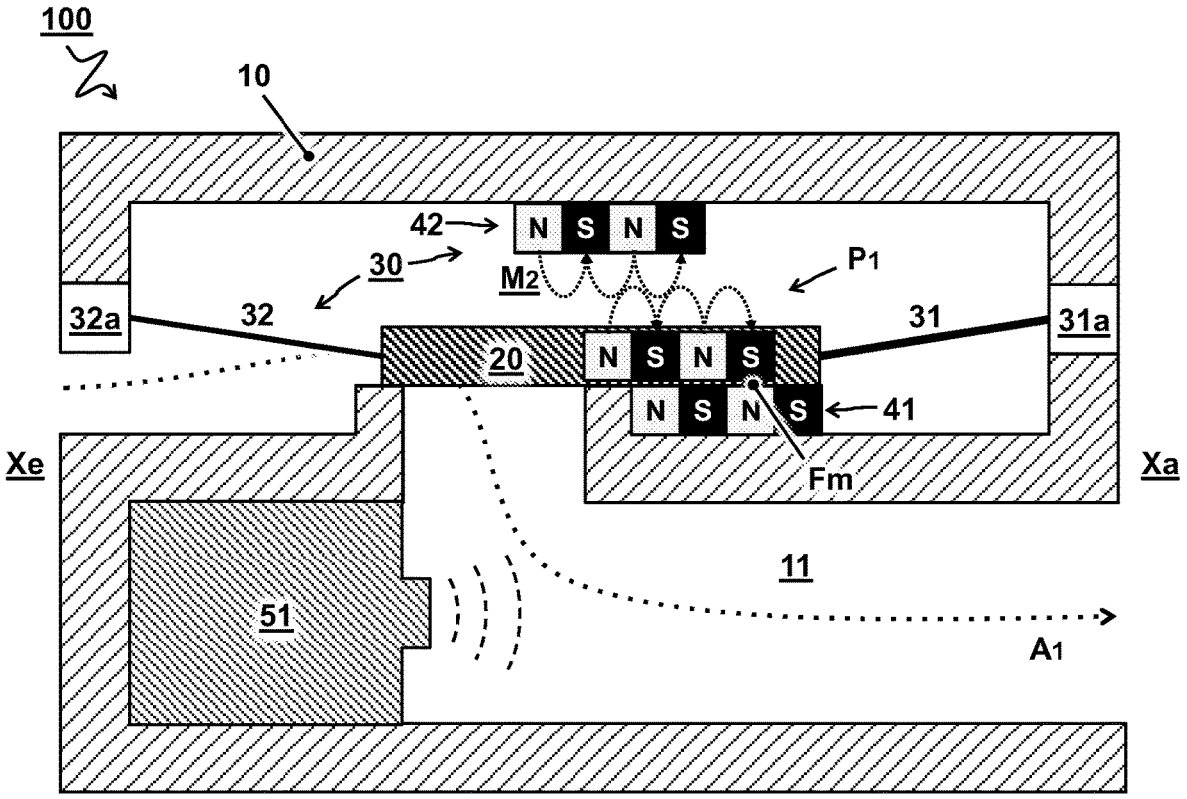
FIGS. 6A and 6B illustrates an acoustic filter with actuator using alternating magnet poles.
Figure 6B:
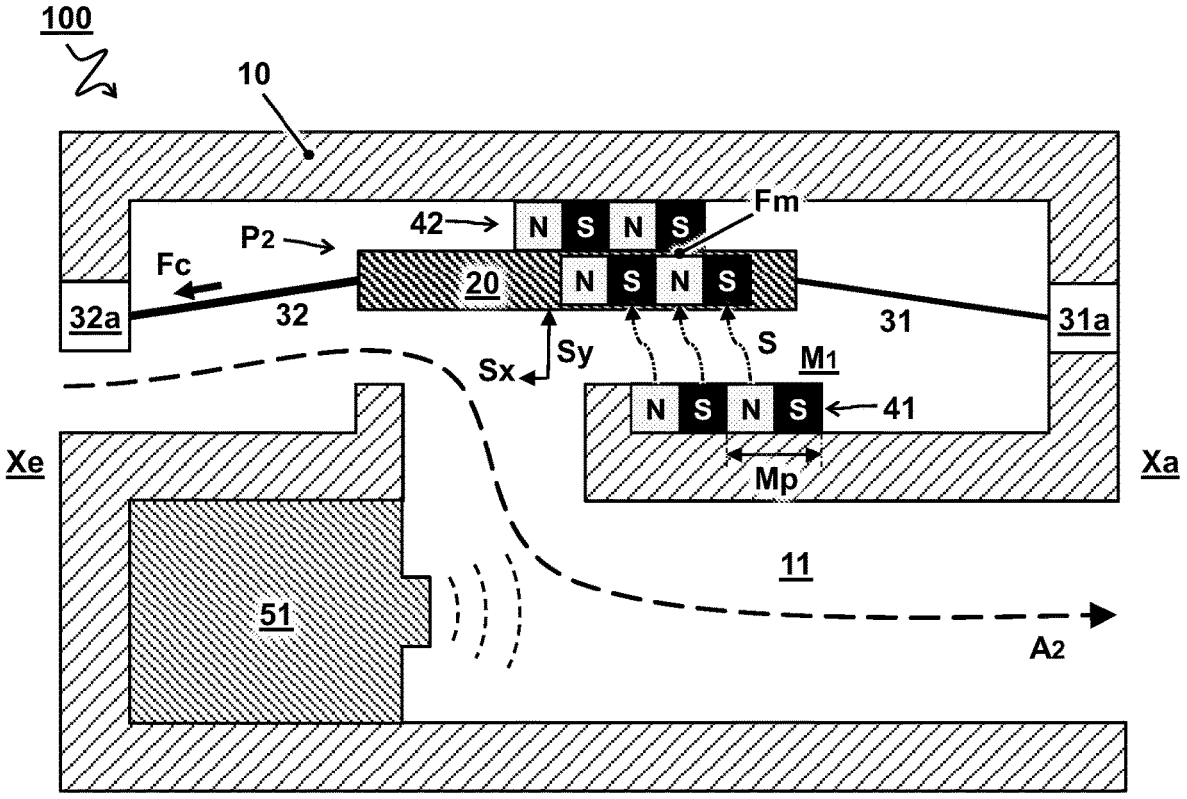

FIGS. 6A and 6B illustrates an acoustic filter 100 with actuator 30 using alternating magnet poles.

In FIG. 6A, the acoustic valve 20 is closed to substantially prevent sound transmission though the acoustic channel 11 and in FIG. 6B, the acoustic valve 20 is open to allow the sound transmission. Also other or additional valves can be used. In the embodiment shown, also an optional sound generator 51 is included, e.g. in a part of the acoustic channel 11 between the acoustic valve 20 and the auditory canal Xa so external sound may be blocked while internally generated sound can be heard.

In some preferred embodiments, the mechanical elements 31,32 are configured to displace the acoustic valve 20 by the contact force "Fc" in a direction transverse to a direct path between the first position "P1" and second position "P2". Most preferably, the magnetic field M1,M2 is shaped to push and/or pull the acoustic valve 20 towards the second position "P2" upon the transverse movement. For example, as shown, the mechanical 32 is configured to pull the acoustic valve 20 in a first direction (here sideways to the left) which causes the first magnetic element 41 exerting a repulsive magnetic force on the acoustic valve 20 in a second direction transverse to the first direction (here generally upward). Then acoustic valve 20 may be attracted to the second magnetic element 42 and lock in the second position "P2". For example, the angle between the first and second directions of the contact force "Fc" and direct line between the first position "P1" and second position "P2" is more than forty degrees, more than sixty degrees, up to ninety degrees (plane angle).

In some embodiments, at least one of the magnetic elements 41,42 comprises two, three, or more magnetic poles N,S arranged in alternating directions. For example, the directions may alternate between north-south, as shown, or in other or further directions. To provide a repulsive force with the acoustic valve 20, preferably, the valve also comprises one or more magnetic elements. For example, alternating magnetic poles connected or incorporated with the movable valve 20 may match corresponding alternating poles of the fixed magnetic elements 41 and/or 42. For example, the alternating magnetic poles in the acoustic valve 20 may have the same periodic distance Mp as in the magnetic elements 41,42.

In some embodiments, the magnetic elements 41,42 comprise magnetic poles N,S which periodically alternate polarity over a periodic distance or angle Mp along a first direction, In other or further embodiments, the mechanical elements 31,32 are configured to displace, by the contact force "Fc", corresponding magnetic poles N,S attached to the acoustic valve 20 at least in the first direction over a displacement distance Sx,Sr less than the periodic distance Mp of the magnetic poles. For example, the periodic distance Mp of recurring poles can be chosen to be more than the displacement distance Sx afforded by the mechanical elements 31,32 by at least a factor 1.2, one-and-half, two, two-and-half, three, or more. For example, the periodic distance Mp is 2 mm which means, each pole is 1 mm. When the magnets are displaced over one pole distance, or even before, the attractive force may turn to a repellant force. This may also depend on other magnets in the vicinity, e.g. the second magnetic element 42 which can take over and pull the valve up already for minor sideways displacements. Accordingly, the upward stroke Sy provided by the magnets, or total stroke e.g. $\sqrt{Sx^2+Sy^2}$, can be enhanced compared to the sideways stroke Sx provided by the mechanical elements 31,32 alone.

Figure 7A:
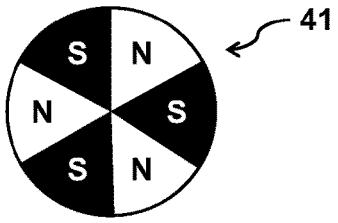
FIGS. 7A-7E illustrates another variation of alternating magnet poles in a rotatable valve.
Figure 7B:
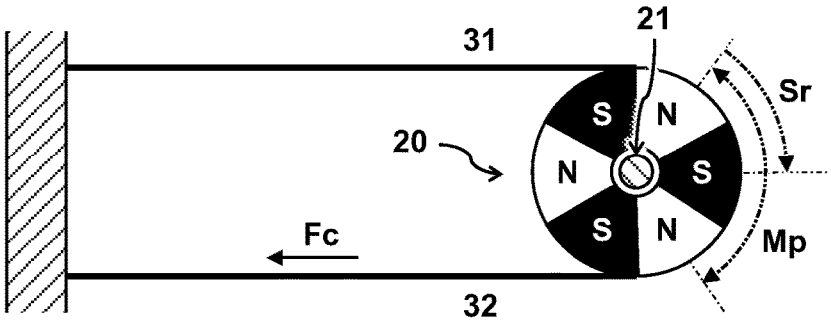
Figure 7C:
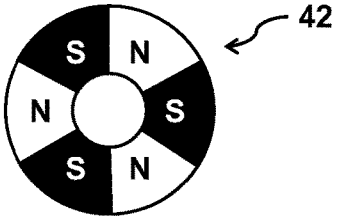
Figure 7D:
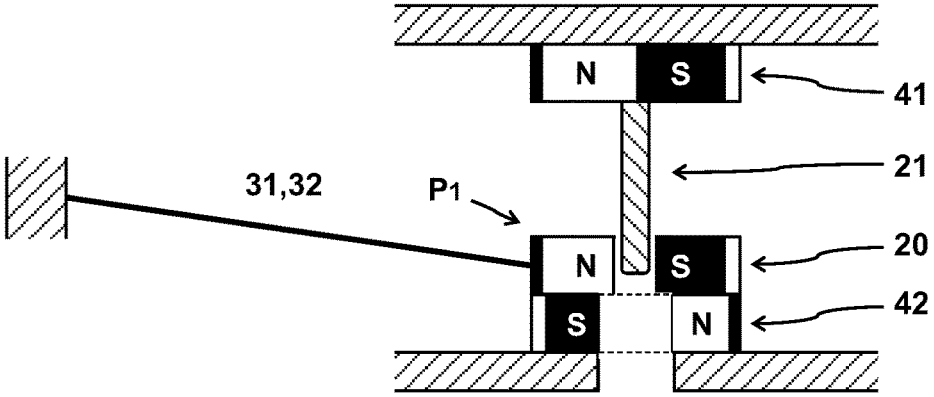
Figure 7E:
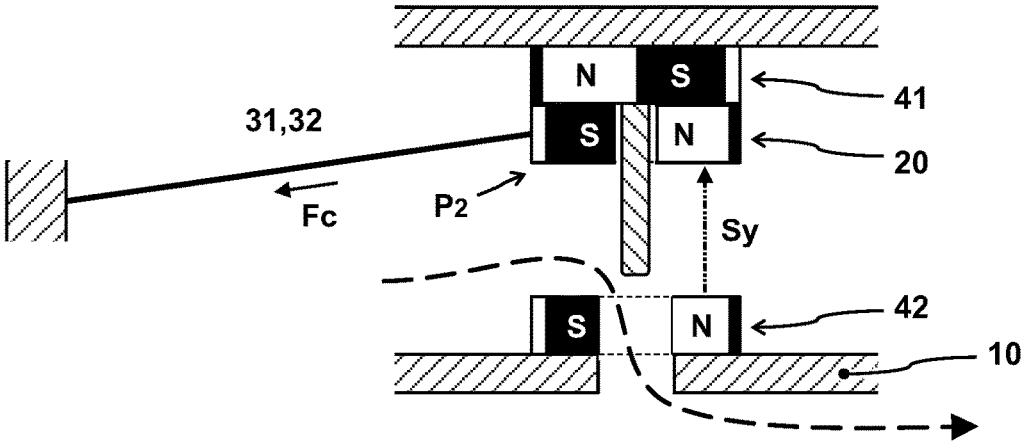

FIGS. 7A-7E illustrates another variation of alternating magnet poles but now in a rotatable valve 20. FIGS. 7A and 7C illustrates top views of the first magnetic element 41 and second magnetic element 42, respectively; FIG. 7B illustrates a top view of the acoustic valve 20; FIGS. 7D and 7E illustrate side views of the valve in closed and open positions, respectively, which may be effected by rotating the valve.

In one embodiment, e.g. as shown the mechanical elements 31,32 are configured to rotate the acoustic valve 20. For example, rotation of the acoustic valve 20 may cause a translation Sy along the rotation axis. To restrict movement of the acoustic valve 20 in the desired direction, a valve guidance 21 can be provided, if needed. In the present embodiment, the valve guidance may comprise a rod whereas the acoustic valve 20 comprises a corresponding hole to slide along the rod while also allowing rotation. Similar or other guidance can also be provided for the other embodiments, e.g. as previously described with reference to FIGS. 6A and 6B (not shown there).

In the embodiment shown, the second magnetic element 42 may comprise a washer which may also act as a valve seat for abutting the acoustic valve 20. Alternatively, the second magnetic element 42 may also be integrated e.g. flush with the filter housing 10. Similar as the previous embodiment of FIGS. 6A and 6B, the magnetic elements 41,42 comprise magnetic poles N,S which periodically alternate polarity but now over a periodic angle Mp along the rotation direction, wherein the mechanical elements 31,32 are configured to displace, by the contact force "Fc", corresponding magnetic poles N,S attached to the acoustic valve 20 in the rotation direction over a displacement distance Sr less than the periodic angle Mp of the magnetic poles.

Figure 8A:
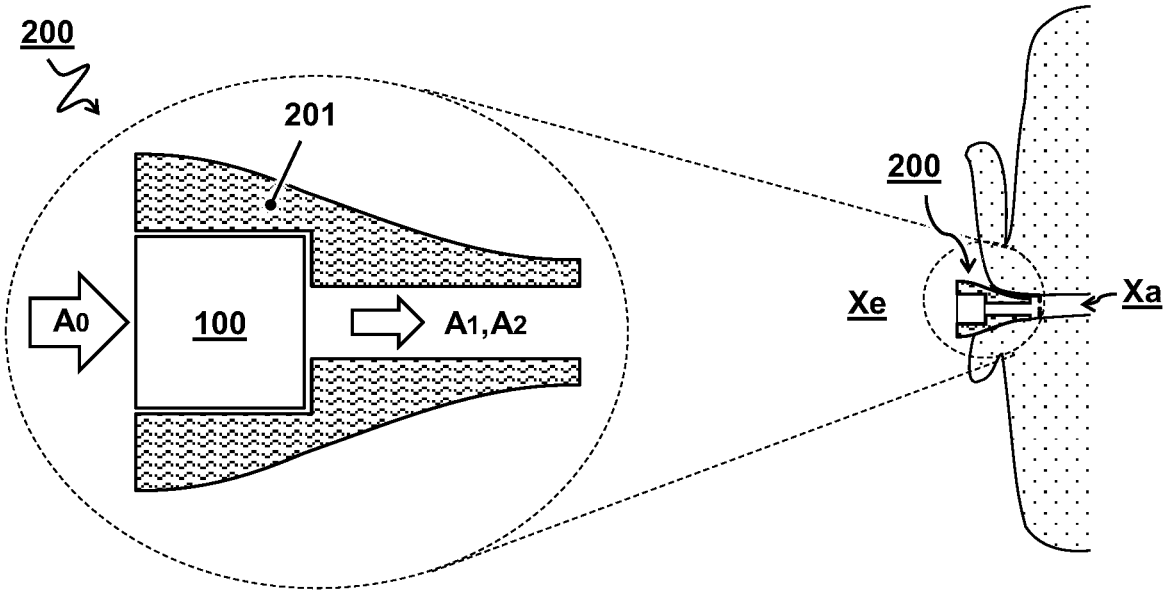
FIGS. 8A and 8B illustrate possible application of the acoustic filter in a hearing device.
Figure 8B:
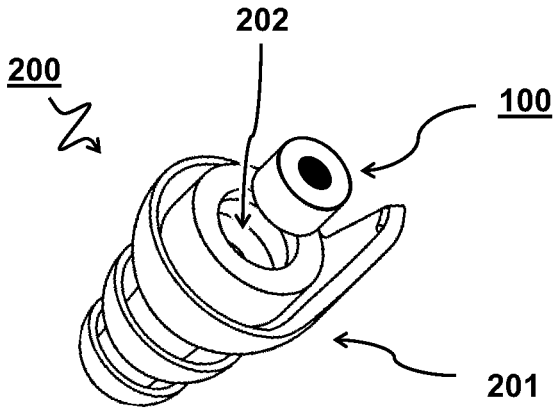

FIGS. 8A and 8B illustrate possible application of the acoustic filter 100 in a hearing device 200. In the embodiment shown, the hearing device 200 comprises an ear plug but the filter may also find application in other hearing devices.

In one embodiment, the filter housing 10 is arranged inside a housing 201 of the ear plug as shown in FIG. 8A on the left. In some embodiments, the housing 201 is configured to at least partially into an ear canal, as shown in FIG. 8A on the right. Preferably, the earplug, e.g. its outer shape and/or material, is configured to sealingly fit into the ear canal. In a preferred embodiment, the hearing device 200, e.g. earplug or headphones (not shown), is configured to substantially block all sound from entering the ear canal, except via the acoustic filter 100. In other or further embodiments, the hearing device 200 comprises a cavity 202 to fit the filter housing 10 of the acoustic filter 100 inside, e.g. in a passage through the hearing device 200.

For the purpose of clarity and a concise description, features are described herein as part of the same or separate embodiments, however, it will be appreciated that the scope of the invention may include embodiments having combinations of all or some of the features described. For example, while embodiments were shown for enhancing stroke and keeping the position of a valve moved by a combination of SMA wires and by magnetic elements, also alternative ways may be envisaged by those skilled in the art having the benefit of the present disclosure for achieving a similar function and result. E.g. other actuators with limited stroke such as piezo elements may be combined with magnets in similar fashion. The various elements of the embodiments as discussed and shown offer certain advantages, such as improved reliability of the positioning. Of course, it is to be appreciated that any one of the above embodiments or processes may be combined with one or more other embodiments or processes to provide even further improvements in finding and matching designs and advantages. It is appreciated that this disclosure offers particular advantages to hearing devices, and in general can be applied for any application wherein actuators of limited or unstable stroke are used.

In interpreting the appended claims, it should be understood that the word "comprising" does not exclude the presence of other elements or acts than those listed in a given claim; the word "a" or "an" preceding an element does not exclude the presence of a plurality of such elements; any reference signs in the claims do not limit their scope; several "means" may be represented by the same or different item(s) or implemented structure or function; any of the disclosed devices or portions thereof may be combined together or separated into further portions unless specifically stated otherwise. Where one claim refers to another claim, this may indicate synergetic advantage achieved by the combination of their respective features. But the mere fact that certain measures are recited in mutually different claims does not indicate that a combination of these measures cannot also be used to advantage. The present embodiments may thus include all working combinations of the claims wherein each claim can in principle refer to any preceding claim unless clearly excluded by context.

The invention claimed is:

1. An acoustic filter comprising:

a filter housing;

an acoustic channel through the filter housing;

an acoustic valve arranged in the acoustic channel and configured to be moveable along a trajectory between a first position and a second position for varying an acoustic characteristic of sound travelling through the acoustic channel between the respective first position and second position of the acoustic valve; and an actuator configured to actuate the acoustic valve along the trajectory, wherein the actuator comprises one or more mechanical elements, at least one of the mechanical elements being a shape-memory alloy (SMA) wire configured to move the acoustic valve along at least an initial part of the trajectory away from the first position by exerting a contact force on the acoustic valve;

wherein the actuator comprises one or more magnetic elements with a magnetic field configured to exert a magnetic force on the acoustic valve and act in conjunction with the contact force exerted by the SMA wire for helping move the acoustic valve to the second position along at least a final part of the trajectory and keep the acoustic valve at the second position.

2. An acoustic filter comprising:

a filter housing;

an acoustic channel through the filter housing;

an acoustic valve arranged in the acoustic channel and configured to be moveable along a trajectory between a first position and a second position for varying an acoustic characteristic of sound travelling through the acoustic channel between the respective first position and second position of the acoustic valve; and an actuator configured to actuate the acoustic valve along the trajectory, wherein the actuator comprises one or more mechanical elements, at least one of the mechanical elements is configured to move the acoustic valve along at least an initial part of the trajectory away from the first position by exerting a contact force on the acoustic valve;

wherein the actuator comprises one or more magnetic elements with a magnetic field configured to exert a magnetic force on the acoustic valve and act in conjunction with the contact force exerted by the mechanical element for helping move the acoustic valve to the second position along at least a final part of the trajectory and keep the acoustic valve at the second position, wherein the one or more mechanical elements have only a limited stroke to move the acoustic valve along the initial part of the trajectory from the first position to an intermediate position partway between the first position and the second position, and wherein the one or more magnet elements are configured to provide the magnetic field to move the acoustic valve by the magnetic force along the final part of the trajectory from at least the intermediate position to the second position, thereby providing an enhanced stroke to move the acoustic valve beyond the limited stroke of the one or more mechanical elements.

3. The acoustic filter according to claim 2, wherein the magnetic field is configured to exert the magnetic force sufficient for moving the acoustic valve to the second position after the acoustic valve is moved by the at least one of the mechanical elements beyond a threshold position away from the first position.

4. The acoustic filter according to claim 1, wherein the actuator comprises a temperature controller for controlling a temperature of the SMA wire, and wherein the SMA wire is configured to contract or extend depending on its temperature to exert a contact force by a connection to the acoustic valve.

5. The acoustic filter according to claim 1, wherein the actuator comprises at least two shape-memory alloy (SMA) wires with respective temperature controllers configured to the selectively heat either one of the SMA wires to cause a contraction in the heated wire, wherein the contraction causes the contact force by pulling the acoustic valve in one of at least two different directions towards the first position or second position depending on which wire is heated.

6. The acoustic filter according to claim 1, wherein the acoustic valve comprises a magnet or magnetisable material enabling the magnetic field to directly exert the magnetic force on the acoustic valve.

7. The acoustic filter according to claim 2, wherein the one or more magnetic elements are arranged to keep the acoustic valve in at least one of the first position or the second position after actuation of the mechanical elements.

8. The acoustic filter according to claim 1, wherein the SMA wire is configured to be heated to a temperature causing contraction from an initial extended length to a heated contraction length, wherein the contraction causes moving the acoustic valve from the first position to an intermediate position beyond a threshold position, but short of the second position due to limited stroke of the SMA wire, wherein the magnetic force is configured to move the acoustic valve further beyond the threshold position from the intermediate position to the second position despite a slack on the SMA wire.

9. The acoustic filter according to claim 2, wherein the one or more mechanical elements are configured to displace the acoustic valve by the contact force in a direction transverse to a direct path between the first position and second position, wherein the magnetic field is shaped to push and/or pull the acoustic valve towards the second position upon the transverse movement.

10. The acoustic filter according to claim 2, wherein the one or more magnetic elements comprise magnetic poles that periodically alternate polarity over a periodic distance or angle along a first direction, wherein the one or more mechanical elements are configured to displace, by the contact force, corresponding magnetic poles attached to the acoustic valve at least in the first direction over a displacement distance less than the periodic distance of the magnetic poles.

11. The acoustic filter according to claim 2, wherein the one or more mechanical elements are configured to rotate the acoustic valve.

12. The acoustic filter according to claim 11, wherein the rotation by the contact force causes a translation along the rotational axis by the magnetic force.

13. A method for acoustic filtering comprising:

providing a filter housing with an acoustic channel there through and an acoustic valve arranged in the acoustic channel and configured to allow movement along a trajectory between a first position and a second position for varying an acoustic characteristic of sound travelling through the acoustic channel between the respective first position and second position of the acoustic valve; and using an actuator to actuate the acoustic valve along the trajectory, wherein the actuator comprises one or more mechanical elements at least one of the mechanical elements moves the acoustic valve along at least an initial part of the trajectory away from the first position by exerting a contact force on the acoustic valve;

wherein the actuator comprises one or more magnetic elements with a magnetic field exerting a magnetic force on the acoustic valve and acting in conjunction with the contact force exerted by the mechanical element thereby helping to move the acoustic valve to the second position along at least a final part of the trajectory and keeping the acoustic valve at the second position, wherein the one or more mechanical elements have only a limited stroke to move the acoustic valve along the initial part of the trajectory from the first position to an intermediate position which is partway between the first position and the second position, and wherein the one or more magnet elements provide the magnetic field that moves the acoustic valve by the magnetic force on the acoustic valve along the final part of the trajectory from at least the intermediate position to the second position thereby providing an enhanced stroke which moves the acoustic valve beyond the limited stroke of the mechanical element.

14. The method according to claim 13, wherein the magnetic field exerts the magnetic force sufficient for moving the acoustic valve to the second position after the acoustic valve is moved by the at least one of the mechanical elements beyond a threshold position away from the first position.

15. The method according to claim 13, wherein the actuator comprises at least one shape-memory alloy (SMA) wire as a mechanical element for actuating the acoustic valve, wherein the SMA wire comprises a shape-memory alloy;

wherein a temperature of the SMA wire is controlled to contract or extend the SMA wire depending on its temperature to exert a contact force by a connection to the acoustic valve.

16. The method according to claim 13, wherein the actuator comprises at least two shape-memory alloy (SMA) wires, wherein either one of the SMA wires is selectively heated to cause contraction in the heated wire, wherein the contraction causes the contact force by pulling the acoustic valve in one of at least two different directions towards the first position or second position depending on which wire is heated.

17. The method according to claim 13, wherein the acoustic valve comprises a magnet or magnetisable material for allowing the magnetic field to directly exert the magnetic force on the acoustic valve.

18. The method according to claim 13, wherein the one or more magnetic elements keep the acoustic valve in at least one of the first position or the second position after actuation of the one or more mechanical elements.

19. The acoustic filter according to claim 1 wherein the acoustic filter is configured to form part of a hearing device.

20. The acoustic filter according to claim 2 wherein the acoustic filter is configured to form part of a hearing device.

* * * * *